US006301722B1

(12) United States Patent
Nickerson et al.

(10) Patent No.: US 6,301,722 B1
(45) Date of Patent: Oct. 16, 2001

(54) PADS AND PADDING FOR SPORTS GEAR AND ACCESSORIES

(75) Inventors: L. Paul Nickerson, Superior; David W. Bainbridge, Golden, both of CO (US)

(73) Assignee: Brock USA, LLC, Boulder, CO (US)

( * ) Notice: Subject to any disclaimer, the term of this patent is extended or adjusted under 35 U.S.C. 154(b) by 0 days.

(21) Appl. No.: 09/387,803

(22) Filed: Sep. 1, 1999

Related U.S. Application Data

(63) Continuation-in-part of application No. 09/226,311, filed on Jan. 7, 1999, which is a continuation-in-part of application No. 09/158,088, filed on Sep. 22, 1998, now Pat. No. 5,920,915.

(51) Int. Cl.[7] ..... A41D 13/00

(52) U.S. Cl. ..... 2/455; 2/267; 2/22

(58) Field of Search ..... 2/455, 456, 462–465, 2/467, 410, 411, 414, 20, 22, 24, 16, 2.5, 102, 69, 92, 161.1, 909, 267, DIG. 1; 5/655.4, 702, 911, 953; 428/71, 309.9, 313.9, 314.4, 316.6, 317.1, 317.5

(56) References Cited

U.S. PATENT DOCUMENTS

| | | |
|---|---|---|
| 1,652,776 | 12/1927 | Galanis . |
| 2,179,631 | 11/1939 | Holder . |
| 2,298,218 | 10/1942 | Madson . |
| 2,404,758 | 7/1946 | Teague et al. . |
| 3,006,780 | 10/1961 | Shaffer . |
| 3,304,219 | 2/1967 | Nickerson . |
| 3,354,578 | 11/1967 | Ryan . |
| 3,459,179 | 8/1969 | Olesen . |
| 3,477,562 | 11/1969 | Allen et al. . |
| 3,489,154 | 1/1970 | Kaspar . |
| 3,503,841 | 3/1970 | Sterrett . |
| 3,529,306 | 9/1970 | Thorne . |

(List continued on next page.)

FOREIGN PATENT DOCUMENTS

| | | |
|---|---|---|
| 577 328 | 7/1976 | (CH) . |
| 2495-453 | 6/1982 | (FR) . |
| 2616-655 | 12/1988 | (FR) . |
| 1 378 494 | 12/1974 | (GB) . |

OTHER PUBLICATIONS

Sales Literature of JSP International 1998.

Sales Literature Of Faytex Corp., circa 1998.

24 p. Brochure of Porex Technologies 1989–1992.

*Primary Examiner*—John J. Calvert
*Assistant Examiner*—Tejosh Patel
(74) *Attorney, Agent, or Firm*—W. Scott Carson

(57) ABSTRACT

Flexible pads primarily intended for use as protective padding for athletes and other users. In one preferred embodiment, the pads include two, outer layers of substantially inelastic material spaced apart by a middle section of discrete beads of substantially elastic, resilient material. Adjacent beads of the middle section preferably abut one another and are integrally joined to each other. Similarly, the outer layers of the pad contact adjacent beads of the middle section sandwiched therebetween and are joined to them to form an integral, strong pad. The outer layers of the pads are preferably porous and breathable and made of waterproof (non-absorbent) material. The resilient beads are preferably also made of waterproof material wherein moisture and air will readily pass through the assembled pads but will not be absorbed by any of the component layers or beads. The pads help to keep the athlete cool and dry in use and can be washed and dried for re-use. In other embodiments, adjacent beads are not joined and/or are spaced from each other. The outer layers of the pads can also be made of elastic, stretchable material if desired. Further, in many applications such as jerseys and pants, the sports gear or accessory can be made entirely of the padded structure of the present invention.

43 Claims, 11 Drawing Sheets

U.S. PATENT DOCUMENTS 3,552,044 1/1971 Wiele .
3,563,837 2/1971 Smith et al. .
3,606,726 9/1971 Spertus et al. .
3,608,961 9/1971 Heck .
3,616,162 10/1971 Noziere .
3,629,882 12/1971 Thorne .
3,640,787 2/1972 Heller .
3,663,344 5/1972 Brock et al. .
3,663,469 5/1972 Weissmahr .
3,676,288 7/1972 Hoyle .
3,755,063 8/1973 Massey et al. .
3,762,404 10/1973 Sakita .
3,816,234 6/1974 Winfield .
3,857,731 12/1974 Merrill, Jr. et al. .
3,864,181 2/1975 Wolinski et al. .
3,889,444 6/1975 Davis et al. .
3,968,530 7/1976 Dyson .
3,968,620 7/1976 Keltner .
3,978,263 8/1976 Wellensiek .
4,011,611 3/1977 Lederman .
4,054,204 10/1977 Keeton .
4,102,109 7/1978 Modra et al. .
4,121,399 10/1978 Verville .
4,139,920 2/1979 Evans .
4,171,549 10/1979 Morrell et al. .
4,193,499 3/1980 Lookholder .
4,229,398 10/1980 Harvey .
4,239,519 12/1980 Beall et al. .
4,240,998 12/1980 Lichter et al. .
4,243,617 1/1981 Burge .
4,343,047 8/1982 Lazowski .
4,370,754 2/1983 Donzis .
4,391,561 7/1983 Smith et al. .
4,432,110 2/1984 Sutton .
4,441,905 4/1984 Malmendier et al. .
4,443,286 4/1984 Ikeda et al. .
4,472,472 9/1984 Schultz .
4,475,248 10/1984 L'Abbe et al. .
4,492,877 1/1985 Burnett .
4,577,358 3/1986 Glass .
4,606,087 8/1986 Alivizatos .
4,607,403 8/1986 Alivizatos .
4,620,633 11/1986 Lookholder .
4,624,893 11/1986 Shibano et al. .
4,640,080 2/1987 Wright .
4,642,814 2/1987 Godfrey .
4,657,003 4/1987 Wirtz .
4,705,715 11/1987 DeCoste, Jr. et al. .
4,740,416 4/1988 DeCoste, Jr. et al. .
4,751,202 6/1988 Toussaint .
4,751,203 6/1988 Toussaint .
4,756,026 7/1988 Pierce .
4,855,170 8/1989 Darvell et al. .
4,905,320 3/1990 Squyers, Jr. .
4,989,794 2/1991 Askew et al. .
5,052,874 10/1991 Johanson .
5,055,340 10/1991 Matsumura et al. .
5,073,444 12/1991 Shanelee .
5,079,787 1/1992 Pollmann .
5,080,737 1/1992 Shoner .
5,103,517 4/1992 Krouskop .
5,134,725 8/1992 Yeshurun et al. .
5,134,726 8/1992 Ross .
5,152,019 10/1992 Hirata .
5,201,780 4/1993 Dinsmoor, III et al. .
5,279,237 1/1994 Alivizatos .
5,292,840 3/1994 Heilmann et al. .
5,301,370 4/1994 Henson .
5,351,830 10/1994 Bender et al. .
5,369,829 12/1994 Jay .
5,397,620 3/1995 Hord, III .
5,464,443 11/1995 Wilson et al. .
5,515,975 5/1996 Jarvis et al. .
5,537,688 7/1996 Reynolds et al. .
5,545,128 8/1996 Hayes et al. .
5,584,072 12/1996 Kim et al. .
5,587,231 12/1996 Mereer et al. .
5,614,310 3/1997 Delgado et al. .
5,622,030 4/1997 Steed et al. .
5,626,657 5/1997 Pearce .
5,669,079 9/1997 Morgan .
5,675,844 10/1997 Guyton et al. .
5,694,747 12/1997 Tesch .
5,699,561 12/1997 Broersma .
5,711,029 1/1998 Visco et al. .
5,711,215 1/1998 Sextl et al. .
5,712,015 1/1998 Guillem .
5,720,714 2/1998 Penrose .
5,733,012 3/1998 Jones .
5,746,013 5/1998 Fay, Sr. .
5,778,470 7/1998 Haider .
5,826,273 10/1998 Eckes .
5,888,642 3/1999 Meteer et al. .
5,916,672 6/1999 Reeves .
6,027,806 2/2000 Abe et al. .

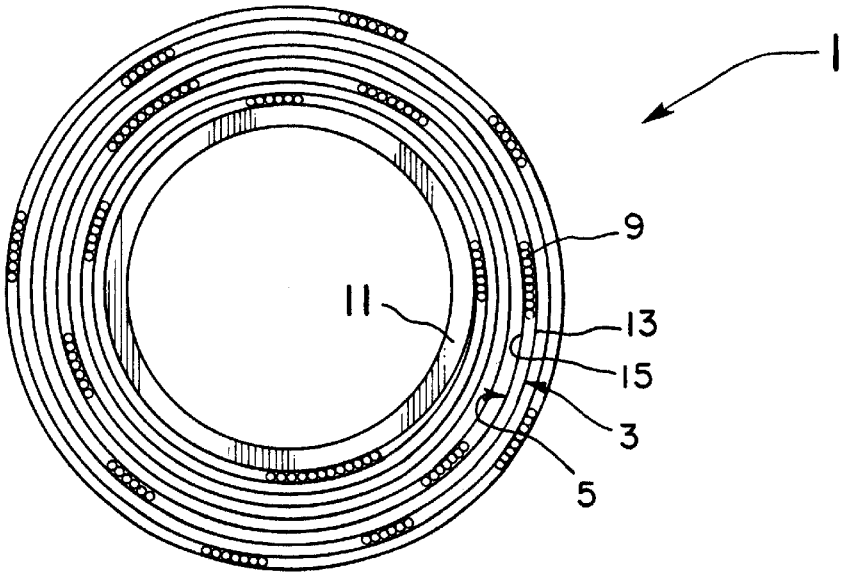
Fig. 4
Fig. 3
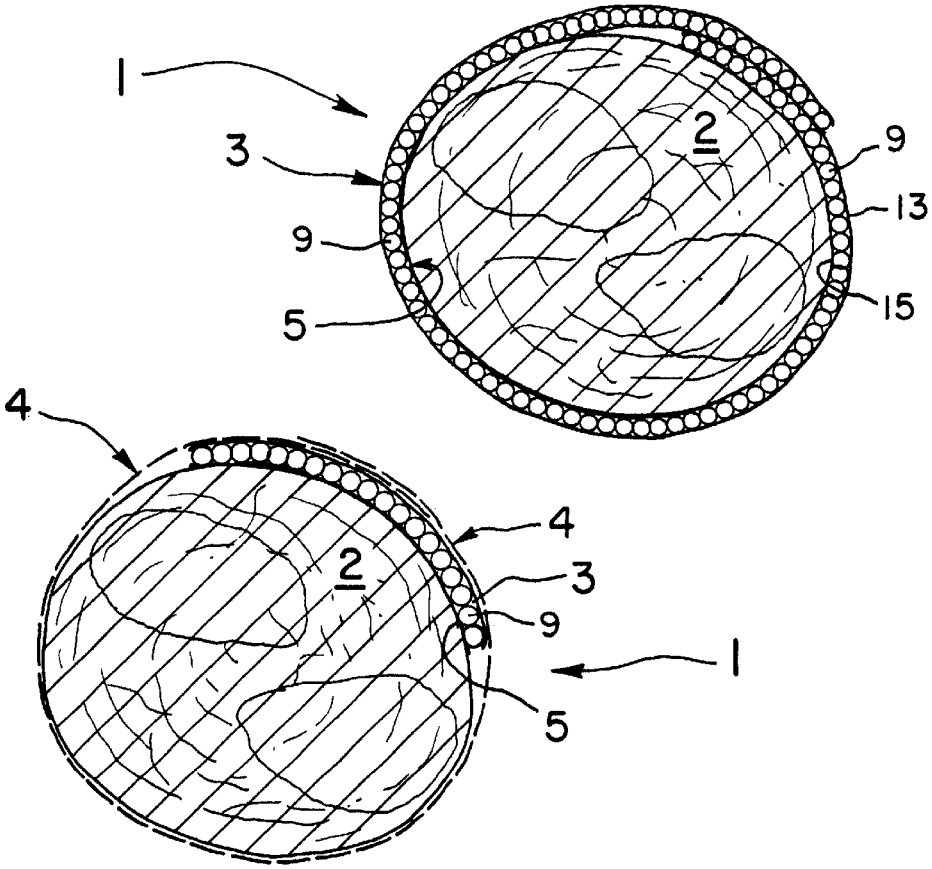
Fig. 5

Fig. 12
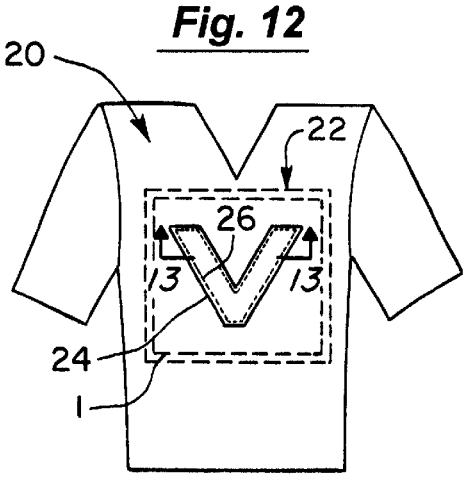
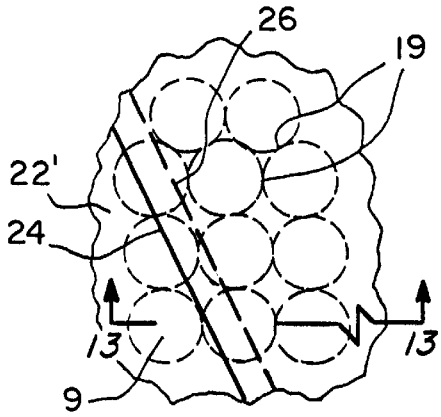
Fig. 14
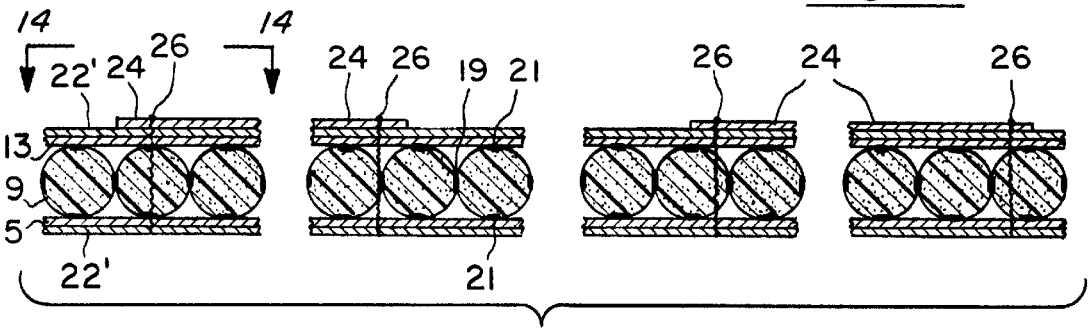
Fig. 13
Fig. 15
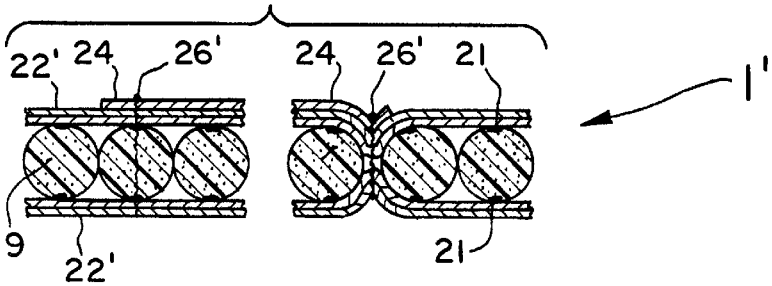
Fig. 16
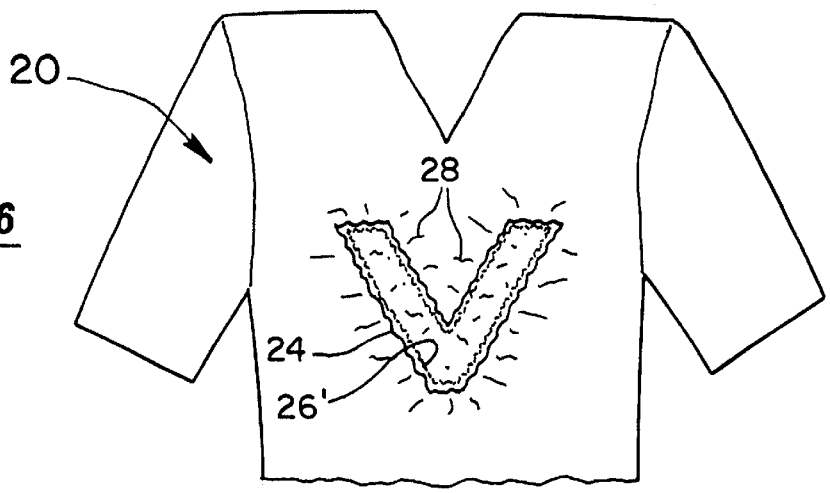

Fig. 17
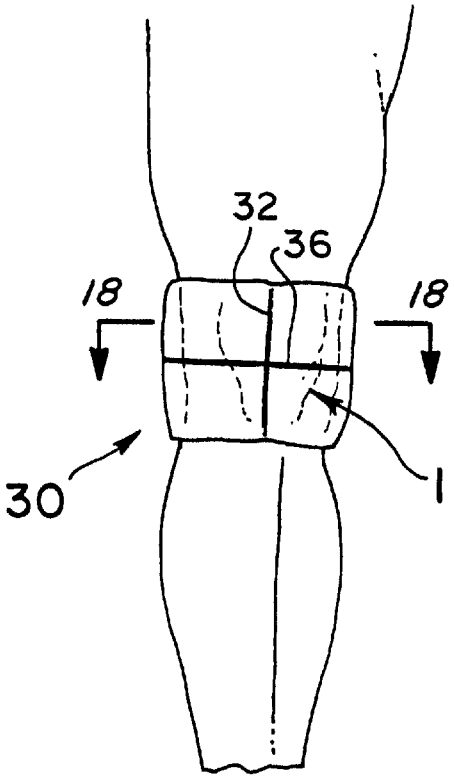
Fig. 18
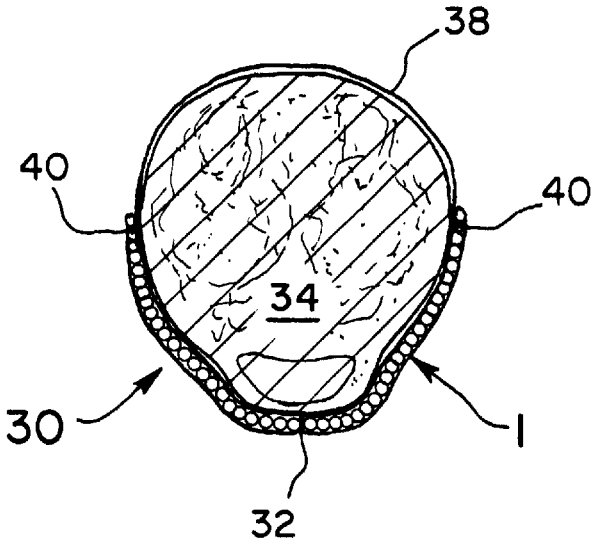
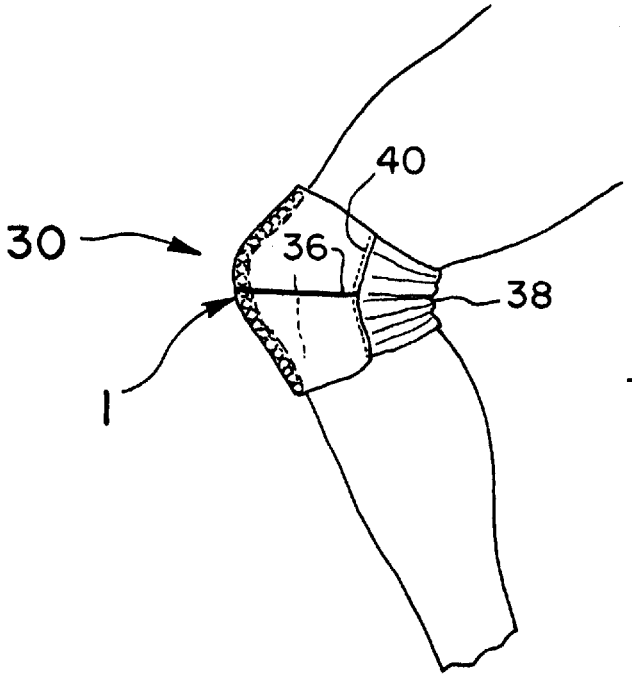
Fig. 19

Fig. 20
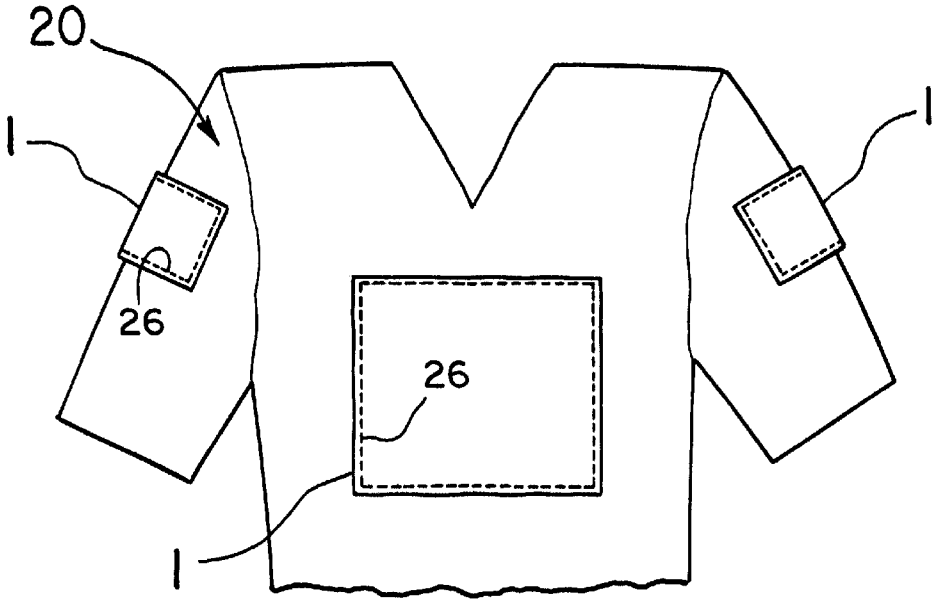
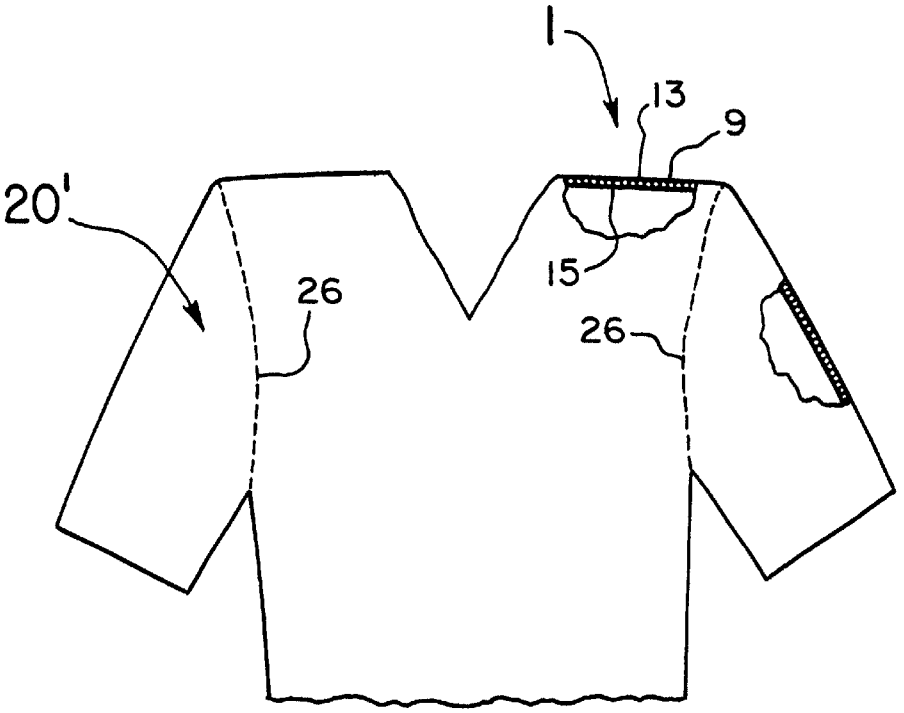
Fig. 21

Fig. 27
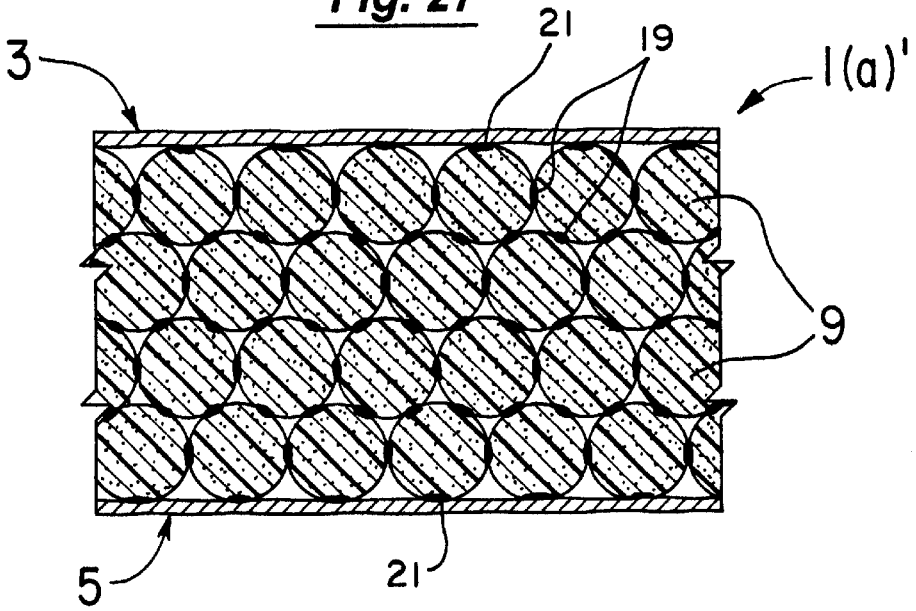
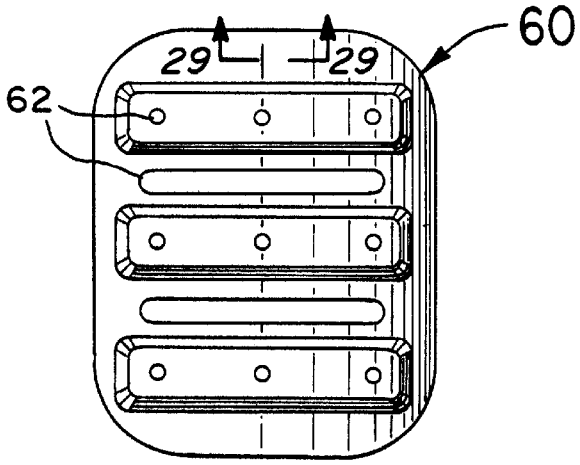
Fig. 28
Fig. 29
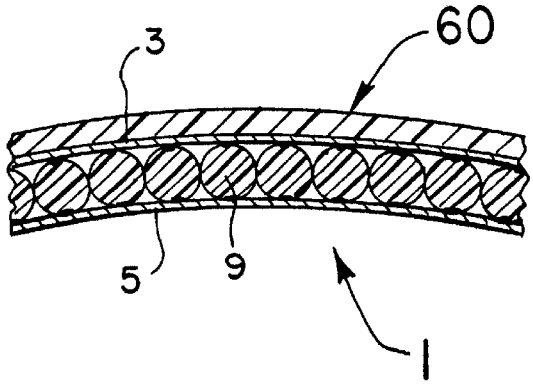

Fig. 30
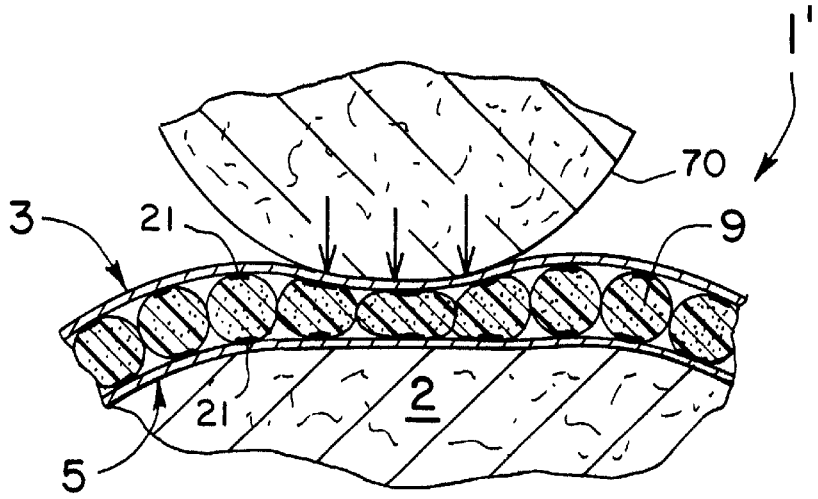
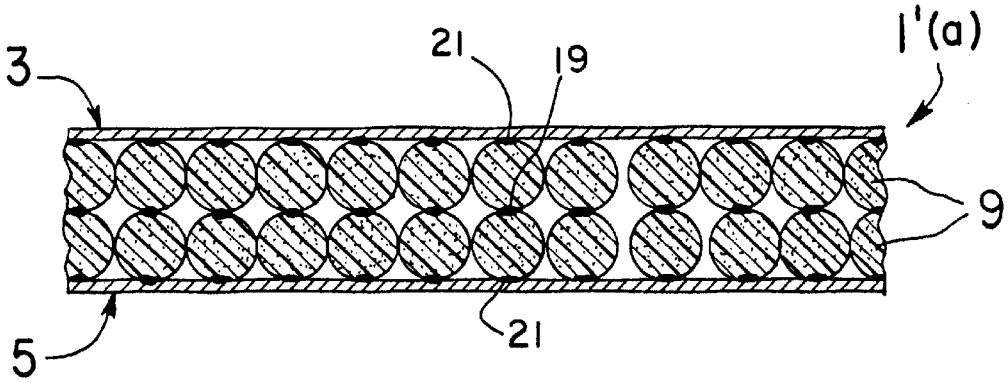
Fig. 31
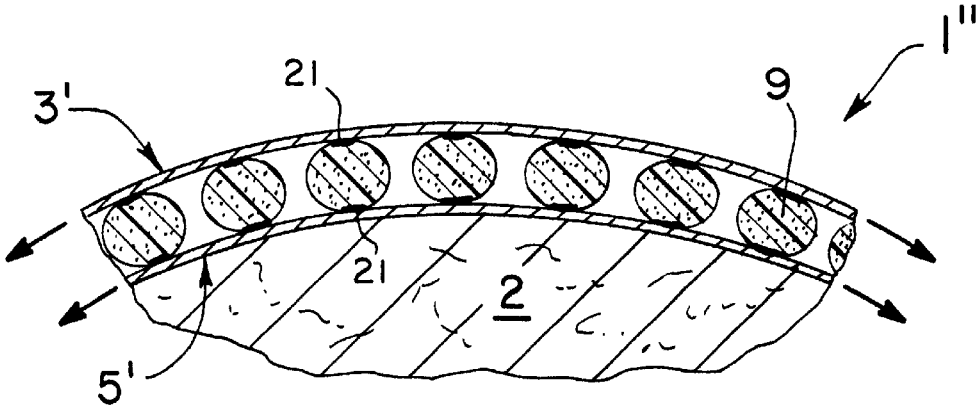
Fig. 32

PADS AND PADDING FOR SPORTS GEAR AND ACCESSORIES

RELATED APPLICATIONS

This application is a continuation-in-part of U.S. patent application Ser. No. 09/226,311 filed Jan. 7, 1999, which is a continuation-in-part of U.S. patent application Ser. No. 09/158,088 filed Sep. 22, 1998, now U.S. Pat. No. 5,920,915.

BACKGROUND OF THE INVENTION

1. Field of the Invention

This invention relates to the field of pads and padding and more particularly, to the field of pads and padding primarily intended for use with sports gear and accessories to provide protection for athletes.

2. Discussion of the Background

Most pads and padding are presently not integrated (or at least not easily integrated) into sports gear and accessories. For example, tapes for athletic use currently consist primarily of single layer, bandage-type tapes that are wound around or applied over various parts of the athlete's body. In a common application, the tape may be wound around an ankle or wrist to provide additional support and to help restrict or limit the movement or flexure of the joint to avoid injury or further injury to it. Smaller pieces of such bandage-type tape may also be used to hold protective pads in place over various parts of the athlete's body. Depending upon the particular application and desires of the athlete, such tapes may be elastic to move and stretch with the athlete's movements or may be inelastic to provide restricting support and protection. Regardless, such prior tapes are normally not designed to additionally act or serve as protective pads and padding in and of themselves. Similarly, other sports gear and accessories such as jerseys, pants, kneepads, elbow pads, and the like are presently not easily adaptable to act or serve as protective pads and padding in and of themselves.

With this in mind, the present invention was developed to offer many of the advantages and simplicity of current sports gear and accessories but with the additional advantage of incorporating protective pads and padding. Further, the pads and padding of the present invention do so in an overall design that is very porous and breathable and will help to keep the athlete dry and cool in use.

SUMMARY OF THE INVENTION

The present invention involves flexible pads primarily intended for use as protective padding for athletes and other users. The pad technology of the present invention can be easily integrated into nearly all sports gear and accessories. In one preferred embodiment, the pads include two, outer layers of substantially inelastic material spaced apart by a middle section of discrete beads of substantially elastic, resilient material. Adjacent beads of the middle section preferably abut one another and are integrally joined (e.g., glued or fused) to each other. Similarly, the outer layers of the pad contact adjacent beads of the middle section sandwiched therebetween and are joined to them. In this manner, the joined beads and outer layers form an integral, strong pad. In the specific application of the pad technology to make a tape, the padded tape can be used in most applications like conventional tapes yet will additionally provide protective padding for the athlete or other user.

The outer layers of the pads are preferably porous and breathable and made of waterproof (i.e., non-absorbent) material such as woven, non-woven or knitted polyester or polypropylene. The resilient beads are preferably made of waterproof (i.e., non-absorbent) material such as closed-cell, polypropylene or polyethylene foam, blends of polypropylene and polyethylene foams, or rubberized polypropylene and/or polyethylene foams). Consequently, moisture and air will readily pass through the assembled pads but will not be absorbed by any of the component layers or beads. The pads will also help to keep the athlete cool and dry in use and can be washed and dried for re-use if desired.

The middle section of beads can have one or more sublayers of beads of the same or different sizes, shapes, densities, and materials depending upon the desired application. When adapted for use as a tape, the outer surfaces of the pad layers can be coated with pressure sensitive adhesives for ease of use. The pads of the present invention can be used with hard, outer shells if desired. Further, although the beads of the present invention are preferably integrally joined to each other to add integrity to the pads, adjacent beads can be unjoined and/or spaced apart and still function effectively in certain situations as protective padding for the athlete or other user. In still other applications, the outer layers of the pads can be made of elastic, stretchable material if desired. Also, in many applications such as jerseys and pants, the sports gear or accessory can be made entirely of the padded structure of the present invention.

BRIEF DESCRIPTION OF THE DRAWINGS

FIG. 3 illustrates the basic pad structure of the present invention adapted for use as a padded tape which can be packaged and rolled on a core spool for ease of handling and delivery.

FIG. 4 shows a strip of the padded tape of FIG. 3 wrapped completely around the forearm of a user and held in place by pressure sensitive adhesives on the overlapping portions of the tape.

FIG. 5 is a view similar to FIG. 4 in which a smaller piece of the padded tape of FIG. 3 is positioned over a portion of the athlete's forearm and additionally held in place by a wrapping of conventional tape.

FIG. 12 illustrates the use of basic pad structure of the present invention adapted for use as a relatively flat and thin (i.e., low profile), sternum pad sewn into a jersey.

FIGS. 13 and 14 along with FIG. 12 illustrate one of the commercial advantages of the basic pad structure of the present invention wherein the integrally joined beads of one preferred embodiment enable the pad to take a relatively straight, stitch line. In this manner, the pad can be sewn directly into items like the jersey of FIG. 12 leaving a neat, commercially acceptable appearance.

FIGS. 15 and 16 contrast FIGS. 12–14 and illustrate the commercially unacceptable appearance that can result in a jersey in which the beads of the underlying pad are not joined to each other.

FIGS. 17–19 show the basic pad structure of the present invention adapted for use in a kneepad.

FIG. 20 illustrates a jersey to which small pads according to the present invention have been sewn directly over the sternum area and upper arms.

FIG. 21 illustrates a jersey made entirely of the basic pad structure of the present invention.

FIG. 27 illustrates a pad similar to the pad FIG. 24 but with four sublayers of beads.

FIGS. 28 and 29 illustrate the basic pad structure of the present invention adapted for use with a hard, outer shell.

FIG. 30 shows a pad according to the present invention with unjoined beads being used to effectively absorb forces applied by a relatively large object.

FIG. 31 shows a pad similar to the pad of FIG. 30 but with multiple sublayers of beads. The outer layers of FIG. 31 are preferably inelastic but could be elastic in the fashion of FIG. 32.

FIG. 32 illustrates a modified pad in which the outer layers are made of elastic, stretchable material and the beads are only joined to the outer layers of the pad and not to each other.

DETAILED DESCRIPTION OF THE PREFERRED EMBODIMENTS

Figure 1:
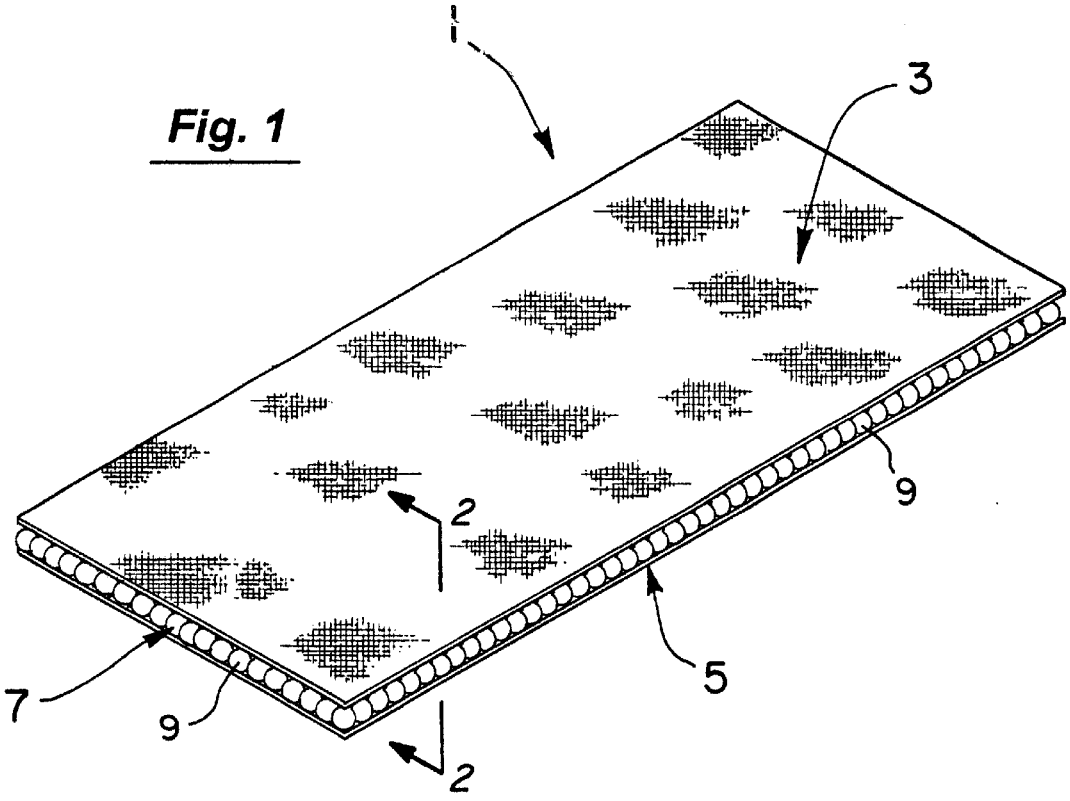
FIG. 1 is a perspective view of the basic pad structure of the present invention.
Figure 2:
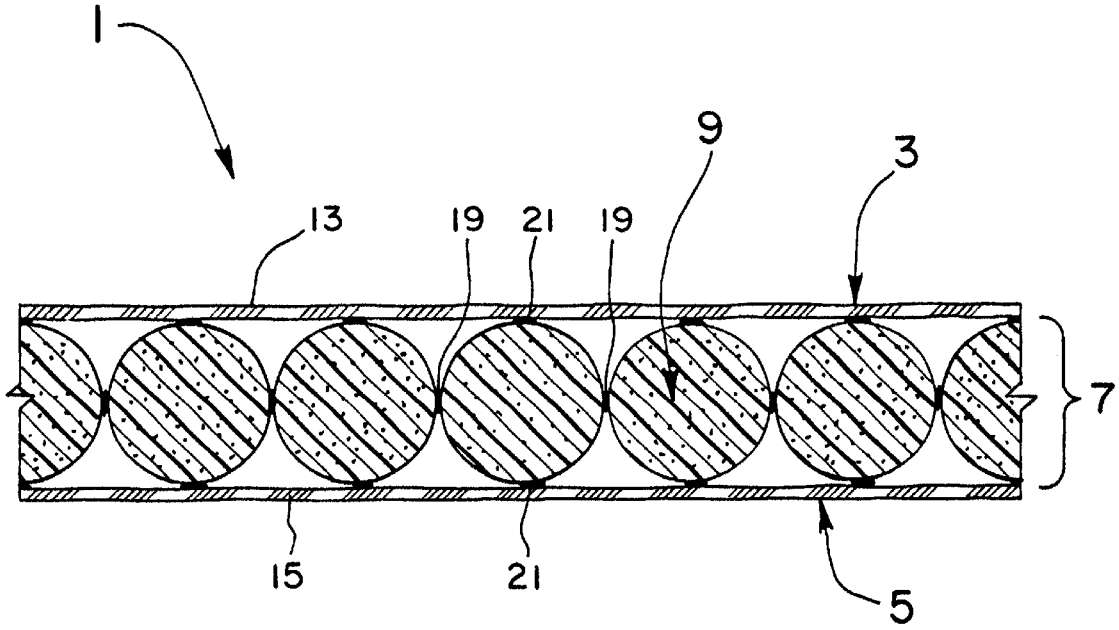
FIG. 2 is a cross-sectional view of the pad taken along line 2—2 of FIG. 1.

The basic pad structure 1 of the present invention as shown in FIGS. 1 and 2 includes first and second, outer layers 3 and 5 spaced apart by a middle layer or section 7 of discrete beads 9. The outer layers 3 and 5 are preferably made of flexible, porous, breathable material (e.g., woven, non-woven, or knitted polyester or polypropylene fabric) that is substantially inelastic and does not appreciably stretch in use. The beads 9 of the middle or sandwiched section 7 are preferably made of substantially elastic, resilient material (e.g., closed-cell, polypropylene foam). Both of the individual materials making up the fabrics of the layers 3 and 5 (e.g., woven, non-woven, or knitted polyester or polypropylene) and the beads 9 (e.g., closed-cell, polypropylene or polyethylene foam, blends of polypropylene and polyethylene foams, or rubberized polypropylene and/or polyethylene foams) are preferably waterproof and do not absorb moisture or odors. Consequently, the assembled pad 1 of the present invention will readily pass moisture and air without absorbing them and will help to keep the athlete using the pad 1 cool and dry.

The entire pad 1 is flexible and can be easily adapted for a number of uses as well as packaged and delivered in a number of convenient manners. For example, in FIGS. 3–5, the present invention has been adapted to form a padded tape 1 that can be placed as a spiral roll on a core spool 11 (see FIG. 3). In doing so, one or both of the outer surfaces 13 and 15 of the tape layers 3 and 5 (see FIGS. 2 and 3) can be coated with a pressure sensitive adhesive. The surfaces 13 and 15 of layers 3 and 5 will then self-adhere to each other and the tape 1 can simply be spirally rolled about the spool 11 and itself into the shape of FIG. 3. In use, the padded tape 1 of FIG. 3 can be easily and quickly drawn off and placed about the athlete's body part to be protected (e.g., forearm 2 of FIG. 4). The self-adhering coating on at least surface 15 and preferably on both surfaces 13 and 15 will then stick to each other and to the athlete 2 to hold the tape 1 in place. Alternatively, a smaller piece of the padded tape 1 can be positioned as shown in FIG. 5 and held in place by the pressure sensitive adhesive coating on surface 15 and/or by an additional wrapping of conventional, adhesive tape 4.

Figure 6:
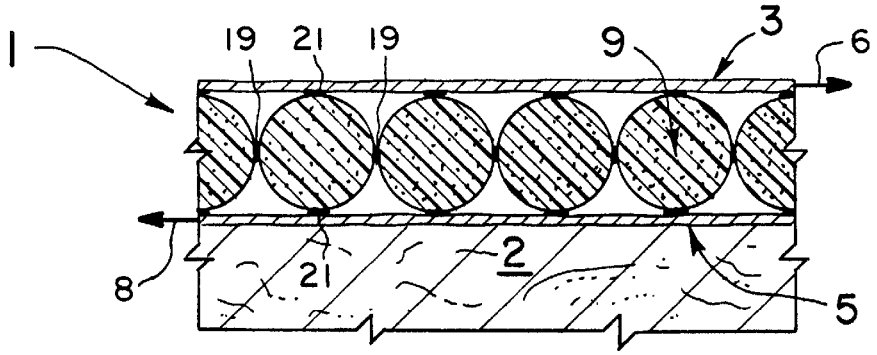
FIGS. 6 and 7 illustrate the advantage of integrally joining adjacent beads in the middle section of the pad to better resist shearing forces.
Figure 8:
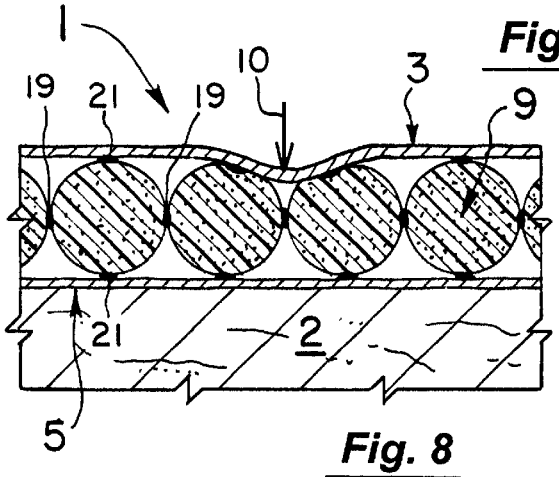
FIGS. 8 and 9 show the advantage of integrally joining adjacent beads in the middle section of the pad to better absorb relatively sharp blows.
Figure 9:
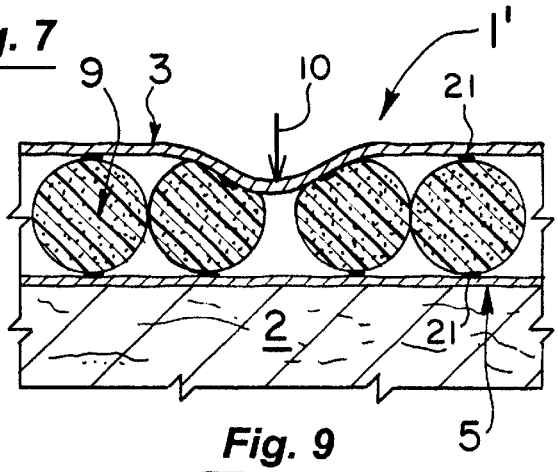
Figure 10:
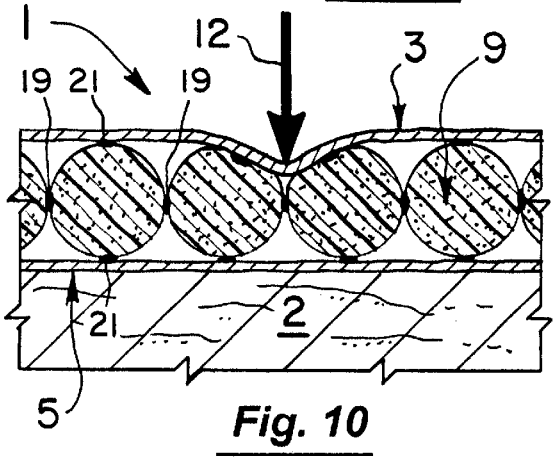
FIGS. 10 and 11 are similar to FIGS. 8 and 9 and illustrate the advantage of the integrally joined beads to avoid having the two, outer layers of the pad bottom out against each other under the force of a heavy blow.
Figure 11:
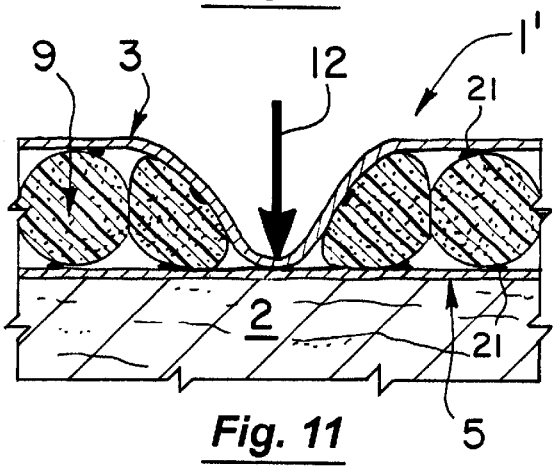

As best seen in FIGS. 2 and 6, substantially all of the adjacent beads 9 of the present invention preferably abut one another and are integrally joined (e.g., glued, fused) to each other at 19. Additionally, the outer layers 3 and 5 preferably contact and are integrally joined (e.g., glued, fused) to the beads 9 at 21. In this manner, the beads 9 and outer layers 3 and 5 form a strong, integral pad 1. More specifically and as illustrated by comparing FIGS. 6 and 7, if the side-by-side beads 9 are not integrally joined to each other (see the tape 1' of FIG. 7), shear forces 6 and 8 can more easily distort and move the outer layers 3 and 5 laterally relative to each other. In contrast, the outer layers 3 and 5 of the bonded or joined beads 9 of FIG. 6 effectively resist such shear forces 6 and 8 tending to move the layers 3 and 5 laterally relative to each other. Similarly, as illustrated in FIGS. 8 and 9, sharp or relatively narrow forces such as 10 applied essentially perpendicularly to the outer layer 3 are resisted more by the preferred tape 1 (FIG. 8) than by the tape 1' of FIG. 9 (whose beads 9 are not integrally joined or connected to each other) In this regard, the unjoined beads 9 of the tape 1' of FIG. 9 tend to move aside when a sharp force such as 10 is applied in a wedge-like manner. In the extreme case of FIG. 11, the unjoined beads 9 of tape 1' may even move completely aside allowing the applied force 12 to undesirably bottom out layers 3 and 5 against the athlete's body 2. In contrast, the joined or adhered beads 9 of the preferred tape 1 in FIG. 10 will substantially absorb the applied force 12 and protect the athlete 2.

Such enhanced resistance to applied forces by the basic pad structure 1 also offers a commercial advantage in that the pad 1 can be sewn or stitched with little distortion. More specifically and referring to FIG. 12, the pad 1 can be made and used in pieces of varying sizes. In this FIG. 12, the basic pad structure of FIGS. 1 and 2 is cut and used as a relatively thin and flat (i.e., low profile), sternum pad 1 sewn into a jersey 20. In such use, the pad 1 can be sewn directly to the jersey 20 if desired or a pocket-like structure 22 can be made in the jersey 20 with the pad 1 positioned in the pocket 22 of FIG. 12 between the pocket layers 22' (see FIG. 13). An ornamental letter 24 (e.g., "V") can even be placed directly over the pocketed pad 1 and the entire assembly of pad 1, jersey pocket layers 22', and ornamental letter 24 sewn together. The material (e.g., nylon mesh) of the jersey 20 and letter 24 in this regard is preferably porous and breathable like the pad 1 to help keep the athlete cool and dry.

Because the pad 1 with its joined beads 9 in FIG. 13 will effectively resist the relatively small sewing forces of the stitches 26, the end result is the neat, commercially acceptable appearance of FIG. 12. This is true even if the stitches 26 pass through the center of a bead 9 (see the left quarter of FIG. 13), between beads 9 (see the left-center quarter of FIG. 13), or through portions of the beads 9 offset from their centers (see the right-center and right quarters of FIG. 13). In running any stitch line 26 along or over the jersey 20 as illustrated in FIG. 14, the stitch line 26 will encounter the underlying beads 9 at all different portions similar to the illustration of FIG. 13. In each case, the resulting stitch line 26 will be straight and neat. In contrast as illustrated in FIGS. 15 and 16, the stitch line 26' of the unjoined beads 9 of the pad 1' may be ragged and commercially unacceptable. That is, the unjoined beads 9 of FIG. 15 will still take a clean stitch 26' through the center of the bead 9 (see the left side of FIG. 15). However, between the beads 9 (see the right side of FIG. 15) and in off-center portions of the beads 9, the jersey 20 and ornamental letter 24 may be depressed to different degrees even by the relatively small forces of the sewing operation. The result may be not only a wavy, stitch line 26' as in FIG. 16 but also undesirable nips and tucks or pulls 28 in the fabric of the jersey 20 and ornamental letter 24. The overall appearance as illustrated in FIG. 16 may then be untidy and commercially unacceptable.

More importantly, this ability of the preferred pad structure 1 with the joined beads 9 to take a straight stitch line enables predetermined fold patterns or locations to be sewn into the pad 1. As for example, with the basic pad structure 1 adapted into a kneepad 30 as shown in FIGS. 17–19, vertical fold or crease line 32 can be sewn or formed to allow the pad 1 to fold and conform better about the front of the knee 34 as in FIG. 18. Such conformation gives the kneepad 30 less of a tendency to rotate or otherwise move out of place in use. Consequently, in this application, a straight stitch line 32 is desirable both for its neat appearance and folding ability. Similarly, a predetermined, sewn, fold line 36 running substantially horizontally as in FIGS. 17 and 19 has both a desirable look and function to help the athlete bend his or her knee in a relatively uninhibited manner. Further, because the pad 1 will take and hold a stitch, an elastic, stretchable rear portion 38 of the kneepad 30 can be sewn directly to the pad 1 at stitch lines 40 in FIGS. 18 and 19. Alternatively, the pad 1 could be encased in a pocket of material (e.g., polyester or polypropylene) at the front of the kneepad 30, much like the pocket 22 of FIG. 12. In more elaborate pads such as 30, it is particularly advantageous that the individual materials of the beads 9 and pad layers 3 and 5 are waterproof (i.e., non-absorbent) so that the assembled pad 1 readily passes moisture without absorbing it. Consequently, more elaborate pads such as 30 (or even the pad 1 if used alone) can be washed and re-used if desired.

In the embodiment of FIG. 20, small pads 1 of the present invention have been sewn directly to a jersey 20 by stitching 26. Such pads 1 can be sewn either to the inside or outside of the jersey 20 and in any desired areas (e.g., sternum and upper arms in FIG. 20). These arrangements do not use or need a pocket 22 as in the embodiment of FIG. 12. Further, as evident above, the basic pad structure 1 of the present invention is in essence a thin, sewable pad that can be made in any desired lengths and widths and because of its integrity can be neatly cut into any desired shapes or patterns. Consequently, as illustrated in FIG. 21, an entire jersey or liner 21' can be made of the pad 1 of the present invention. The resulting, padded jersey 20' or other article of clothing is then both breathable and washable as well as being lightweight and flexible.

Figure 22:
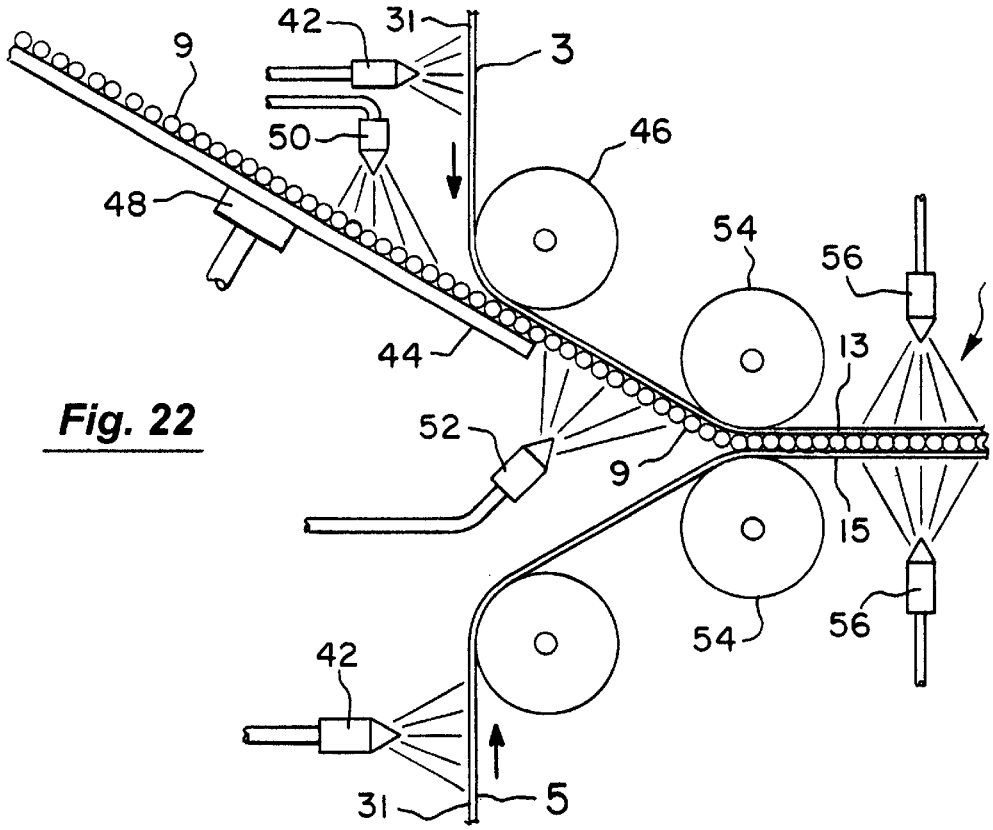
FIG. 22 illustrates an assembly arrangement for making the basic pad structure according to the present invention with a single, sublayer of beads.

The preferred pad 1 with joined beads 9 can be assembled in any number of manners and in any desired lengths and widths. In the assembly illustrated in FIG. 22, the inner surfaces 31 of layers 3 and 5 that end up facing toward the beads 9 are initially sprayed with adhesive (e.g., olefin-based hotmelt such as H. B. Fuller HB-0747) by sprayers 42. The beads 9 are then presented at the bottom of the pan 44 to the inner surface 31 of layer 3 and pinched between the pan 44 and roller 46. Vibrator 48 helps in this regard to deliver the beads 9 to the bottom of the pan 44 in a single layer of abutting beads 9. The beads 9 can be additionally sprayed at 50 while still on the pan 44 to ensure that the adjacent, abutting beads 9 will be joined and will stick to each other. With the beads 9 from tray 44 adhering to the inner surface 31 of layer 3, the beads 9 can be further sprayed at 52 if desired and moved forward between pinching rollers 54 to be joined or adhered to the inner surface 31 of lower layer 5. Finally, sprayers 56 can be used to apply a coating of pressure sensitive adhesive (e.g., olefin-based hotmelt such as H. B. Fuller HB-2081) to the outer surfaces 13 and 15 of the respective layers 3 and S. These outer surfaces 13 and 15 as illustrated in FIGS. 2 and 22 face away from the beads 9 of the middle section 7 of the pad 1.

Preferably, the adhered, contact points or areas 19 and 21 of the resulting pad 1 in FIG. 2 are as small as possible so as not to unduly impede the overall porosity and breathability of the pad 1. Additionally, not all of the illustrated sprayers of FIG. 22 necessarily need to be used. For example, only sprayers 42 and 50 or 52 could be used if desired. Further, the applied sprays in this regard are preferably light mists of an adhesive (e.g., hotmelt) that can be rapidly applied and will quickly setup and cure to full strength. The adhesive is preferably also completely functional in the sense there are no carrier solvents or water to be removed from the system during setup and cure. The adhesive preferably remains as flexible as possible in use while still holding the beads 9 and outer layers 3 and 5 of the pad 1 together. Although a glue or adhesive is preferred to join the beads 9 and outer layers 3 and 5 into the integral pad 1, these components of the pad 1 (and in particular the beads 9) could be directly joined or fused together in other manners (e.g., melted together by steam heat) if desired. Additionally, the beads 9 could be initially fused together into a highly porous block having significant interstitial spaces (e.g., 35% of the total volume of the block). The block could be molded or pre-shaped. It could also have a generic shape (e.g., thin sheets, cubes, and rectaloids) and then be subsequently cut to the desired shape and size. The outer layers 3 and 5 could be unbonded or bonded (e.g., in the general manner of FIG. 22) thereto to form the pad 1. The outer layers 3 and 5 in this regard could also be laid on and fused to the beads of the block if desired. If not bonded or fused to the beads, the outer layers 3 and 5 of this and the other pads would essentially just cover and/or encase the beads.

Figure 23:
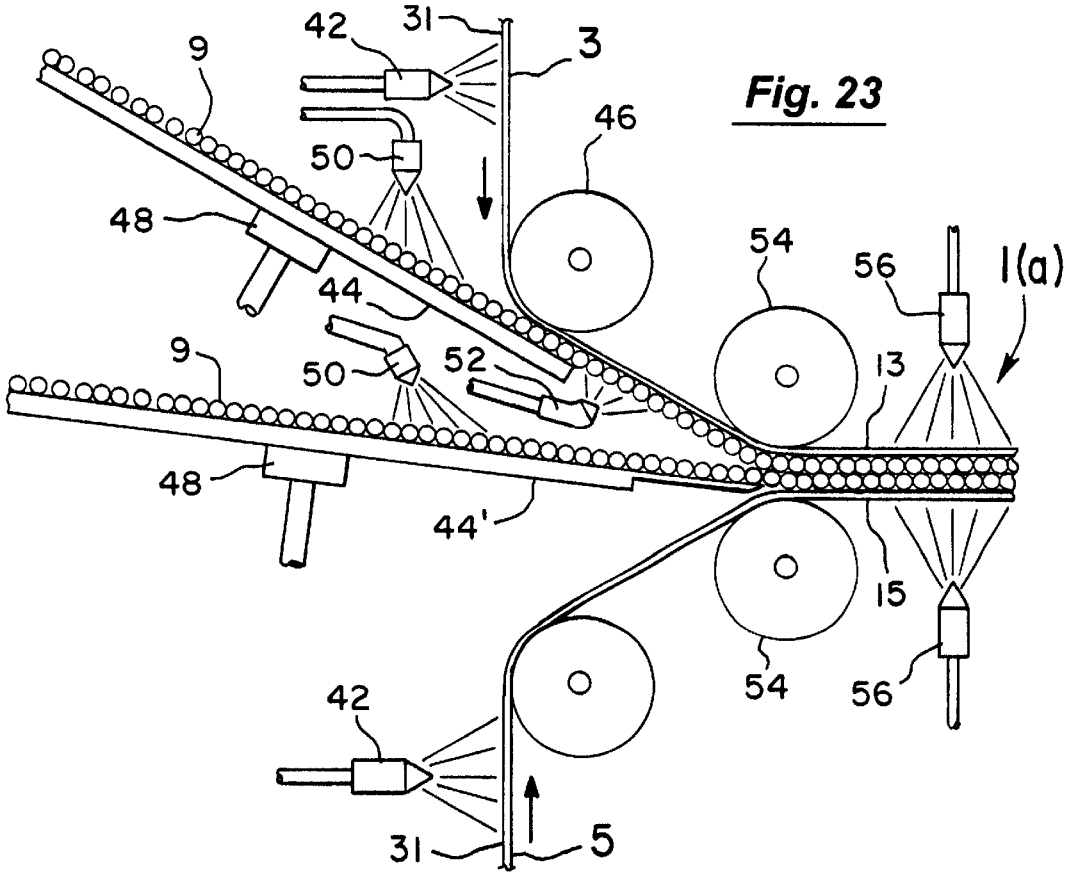
FIG. 23 shows an assembly arrangement for making the basic pad structure according to the present invention with multiple sublayers of beads.
Figure 24:
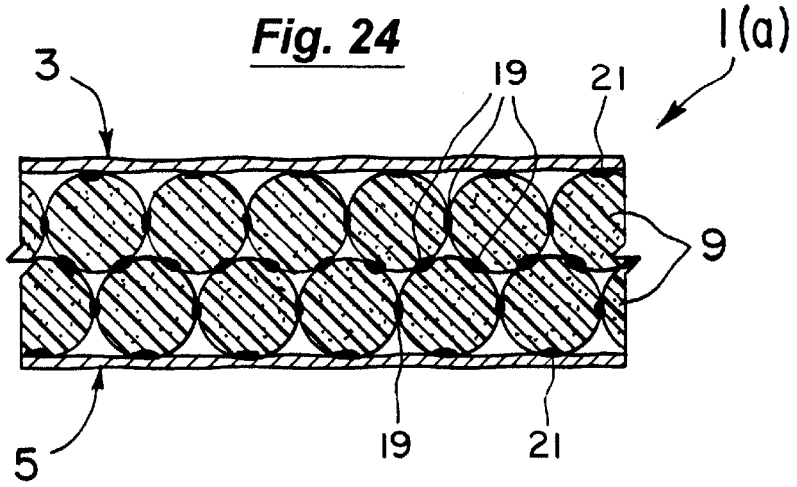
FIG. 24 illustrates a pad with two sublayers as produced by the assembly process of FIG. 23.

FIG. 23 illustrates an assembly arrangement to produce multiple, sublayers of beads 9 as in the pad 1(*a*) of FIG. 24. In the process of FIG. 23, the beads 9 are preferably sprayed by sprayer 52 so the upper sublayer of beads 9 from pan 44 will better adhere to themselves and to the lower sublayer of beads 9 on the lower pan 44'. With the assembly arrangement of FIG. 23, it is also possible to produce a pad 1(*b*) such as in FIG. 25 with multiple layers (e.g., two or more) of beads 9 and 9' of different characteristics (e.g., different sizes, different densities and softness, and different materials). When the beads are made of the same material (e.g., closed-cell, polypropylene foam), the expanded size differences normally translate directly into varying degrees of softness (e.g., ease of compression for a given force or pressure). The larger beads 9 are then softer (e.g., have a lower spring coefficient) and compress more easily than the smaller beads 9'. Consequently, in use when a force or blow is applied, the differently sized beads (e.g., a mix of beads from 0.05 to 0.5 inches in diameter) will normally progressively compress from the largest to the smallest beads to thereby progressively absorb the blow. However, in cases where the blow is relatively light, it may be that only the largest beads are compressed (e.g., down to 40% or smaller of their relaxed, uncompressed volumes). Similarly, if the force is greater, all of the beads regardless of size may be compressed in absorbing the blow.

Figure 25:
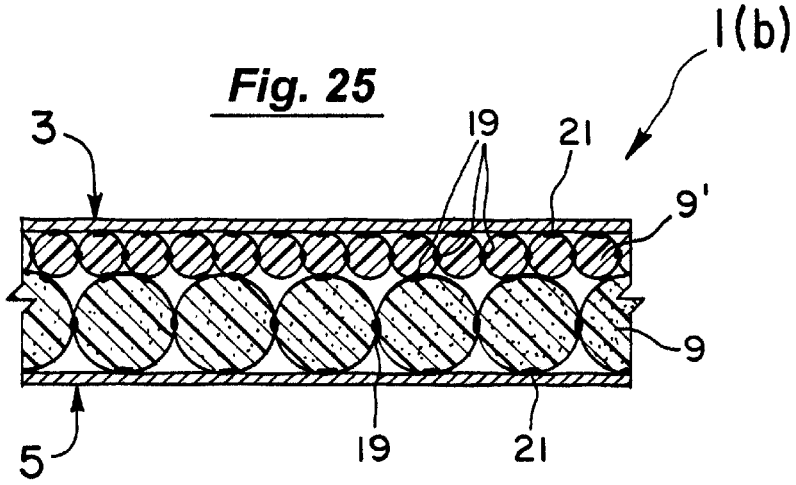
FIG. 25 shows a pad according to the present invention with two sublayers of beads of different sizes.

This operating characteristic is featured in the pad 1(*b*) of FIG. 25 which has an upper sublayer of smaller, more dense, harder beads 9' above a sublayer of larger, less dense, softer (i.e., more easily compressed) beads 9. The abutting, adjacent beads 9 and 9' in FIG. 25 are preferably joined to each other within and between the two sublayers. With the larger beads 9 preferably closer to the athlete's body, any delivered force will first compress the larger, softer beads 9 (e.g., down to 40% or smaller of their relaxed, uncompressed volumes) and then compress the sublayer of smaller, denser beads 9' in a progressive manner. The sublayer of smaller beads 9' will then act more like a safety net or zone. That is, after the larger beads 9 have been initially compressed, the smaller beads 9' will be compressed to absorb the remainder of the hardest blows without allowing the pad 1(*b*) to bottom out against the athlete's body.

Figure 26:
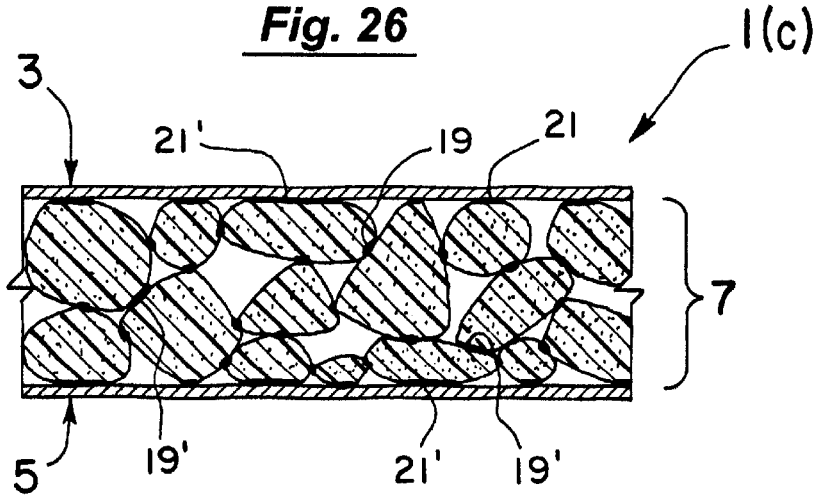
FIG. 26 shows a pad according to the present invention with beads of different sizes and shapes.

Pads with single or multiple sublayers of beads of different sizes and/or shapes (e.g., spheres, cubes, oblongs, pyramids, cylinders, and polygons) as well as varying densities/softness, and materials can also be made with the assembly arrangements of FIGS. 22 and 23. This can be accomplished simply by supplying the different beads to pan 44 and/or pan 44' of these arrangements. For example, pad 1(*c*) in FIG. 26 illustrates an assembled pad with beads of different sizes and shapes. In this regard, beads of different shapes including ones with only slightly rounded and/or relatively flat sides can offer the advantage that more surface area of the beads will abut and adhere to each other and to the pad layers 3 and 5. This can be seen in FIG. 26 by comparing the smaller, contact areas 19 between the beads with the larger, contact areas 19'. Similarly, the smaller, contact areas 21 between the beads and the pad layers 3 and 5 can be compared with the larger, contact areas 21'. The beads in this regard can all be of a uniform shape and size or a mix of sizes and shapes as in FIG. 26. The pressure applied between pinch rollers 54 in FIGS. 22 and 23 to initially compress the beads 9 can also be varied as desired to increase or decrease the adhering, contact area of the abutting beads and layers 3 and S. Increasing the contact, adhering area in this manner can add to the overall strength of the pad. If a particularly strong pad is desired, the bead shapes with the larger contact areas (e.g., flat areas or sides) would preferably be used uniformly throughout the middle section 7. However, the beads would preferably still have substantial interstitial spaces and volumes (e.g., 10%–25% of the entire volume of the middle section 7) so as to maintain the high porosity and breathability of the pad to keep the athlete as cool and dry as possible.

The number of sublayers of beads in FIGS. 24–26 can be varied as desired. For example, by repeating the basic assembly technique of FIG. 23, a four sublayer pad 1(*a*)' as in FIG. 27 can be easily created. This pad 1(*a*)', like any of the pads herein, could also be created from a fused block of beads 9 to which the outer layers 3 and 5 were subsequently bonded. The pad 1(*a*)' and all of the pads of the present invention could additionally be assembled manually if desired.

In FIGS. 28 and 29, the pad 1 of the present invention is adapted for use under a hard, outer shell 60. The shell 60 is preferably provided with numerous openings or perforations 62 so as to be very porous. In this manner, the porous, breathable nature of the pad 1 will not be significantly impeded by the protective shell 60 and the athlete or other user will remain cool and dry. The pad 1 can be sewn to the shell 60 and/or secured to the shell 60 by an adhesive (e.g., pressure sensitive) between the shell 60 and outer surface of pad layer 3 in FIG. 29. This embodiment can be adapted for use under any hard, outer shell (e.g., thigh pad, shin pad, shoulder pad, helmet, or the like).

Figure 7:
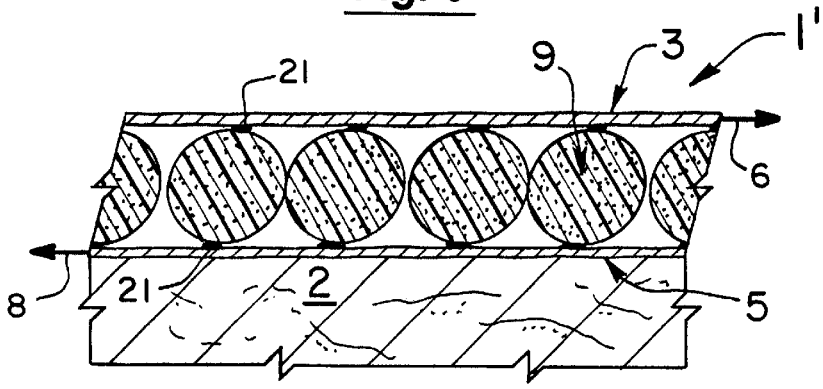

Although the preferred embodiments of the present invention have the beads (e.g., 9) integrally joined (e.g., glued or fused) to each other as in FIGS. 1–6, the pad 1' of FIG. 7 with unjoined beads 9 can also serve to offer some padded protection. With relatively sharp or narrow blows such as 10 and 12 in FIGS. 8–11, joined beads 9 are preferable to avoid bottoming out. However, when less sharp blows are applied as for example by the rounded surface 70 in FIG. 30, the unjoined beads 9 of the pad 1' will be compressed in a manner that will aid in absorbing the blow. Consequently, even the modified pad 1' of FIGS. 7 and 30 with its adjacent beads 9 unjoined can be an effective pad or padding in certain situations to help avoid injury to the athlete 2.

As perhaps best illustrated in this FIG. 30, the pads of the present invention in most applications lie relatively flat against the user's body. Further, because the layers 3 and 5 of the preferred pads are substantially inelastic and do not appreciably stretch, the layers 3 and 5 tend to hammock in response to an applied force like 70 in FIG. 30 and forces like 10 and 12 in FIGS. 8–11. Consequently, the pads of the preferred embodiments not only absorb such applied forces but also distribute and dissipate them over a relatively large area (i.e., much larger than the area of the applied force or forces) to reduce injury to the user. This is true whether the pads are used alone or with hard, outer shells such as 60 in FIG. 29. It is additionally the case even if the pads of the present invention have other pads or protective gear on top of them to initially receive the force of the blow.

The pad 1' of FIG. 30 could also have multiple sublayers (e.g., two or more) as illustrated by the pad 1' (a) in FIG. 31. Similarly, the outer layers 3' and 5' of the pad 1" as in FIG. 32 could be made of substantially elastic, resilient material (e.g., rubberized or blended fabrics) so as to appreciably stretch (e.g., 10% to 30% or more) in use. Like layers 3 and 5 of the preferred pad 1, the material of layers 3' and 5' of pad 1" in FIG. 32 would preferably be very porous and breathable as well as flexible.

The beads 9 of such a pad 1" could be joined to each other if desired to help prevent any bottoming out of the layers 3' and 5'. However, the beads 9 of pad 1" in FIG. 32 are preferably not joined. In this manner, the unjoined beads 9 of pad 1" in FIG. 32 will then easily be pulled apart or separated as the elastic layers 3' and 5' (to which the beads 9 are integrally joined at 21) are initially stretched. Additionally, the unjoined beads 9 of FIG. 32 will thereafter move with the elastic layers 3' and 5' as the layers 3' and 5' further stretch and/or resiliently contract in use to follow the movements of the athlete 2.

The pad 1" could also have multiple sublayers of beads in the manner of FIGS. 24–27 and 31 The laterally adjacent beads in each sublayer could be spaced slightly from each other or could abut one another. If abutting, the beads would preferably not be joined to each other laterally as in FIGS. 30 and 31 and the abutting beads between each sublayer could either be joined in the manner of FIG. 31 or not joined to each other. If the sublayers were joined to each other, the abutting beads between each sublayer would then be joined in a manner top-to-bottom or vertically as in FIG. 31 but the beads in each sublayer would preferably still not be joined laterally to each other. In this regard, such a modified pad 1" in its relaxed or unstretched state with the sublayers joined would essentially look like the pad 1'(*a*) of FIG. 31. In its stretched condition, it would then look substantially like the pad of FIG. 35.

As indicated at the outset, the basic pad structure 1 of the present invention as shown in FIGS. 1 and 2 includes first and second, outer layers 3 and 5 spaced apart by a middle layer or section 7 of discrete beads 9. The outer layers 3 and 5 are preferably made of flexible, porous, breathable material (e.g., woven, non-woven, or knitted polyester or polypropylene fabric). The beads 9 of the middle or sandwiched section 7 are preferably made of substantially elastic, resilient material (e.g., closed-cell, polypropylene or polyethylene foam, blends of polypropylene and polyethylene foams, or rubberized polypropylene and/or polyethylene foams). Both of the individual materials making up the fabrics of the layers 3 and 5 (e.g., woven, non-woven, or knitted polyester or polypropylene) and the beads 9 (e.g., closed-cell, polypropylene or polyethylene foam, blends of polypropylene and polyethylene foams, or rubberized polypropylene and/or polyethylene foams) are preferably waterproof and do not absorb moisture or odors. Consequently, the assembled pads of the present invention will readily pass moisture and air without absorbing them and will help to keep the athlete using the pads cool and dry.

Figure 33:
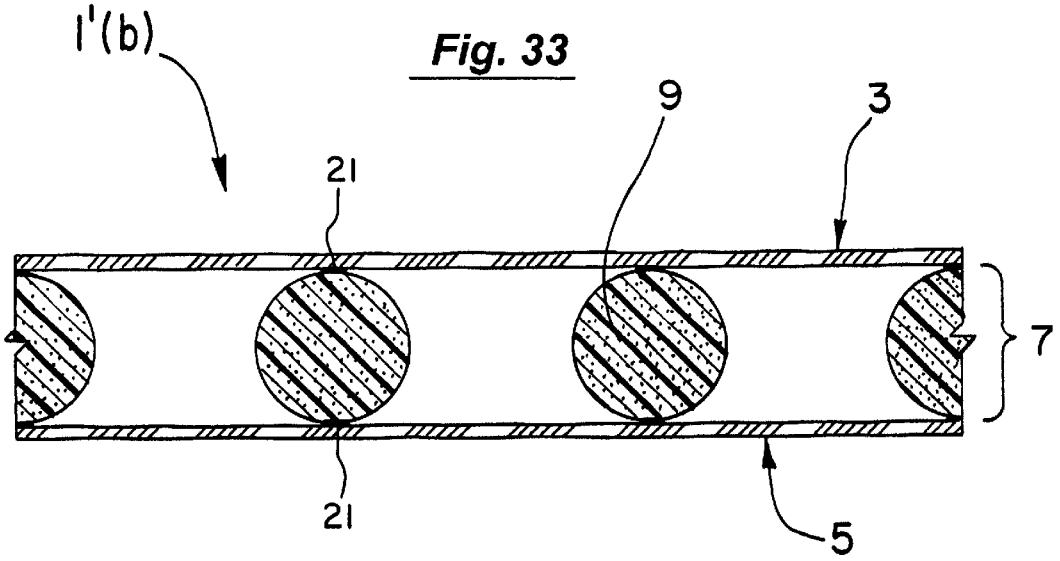
FIG. 33 is a view similar to FIG. 2 but showing the adjacent beads of the pad well spaced from each other.

In applications in which force absorption is paramount, the beads 9 are preferably abutting one another and integrally joined to each other (e.g., see FIGS. 2, 6, 8, 10, and 24–27). Adjacent beads 9 can also abut one another without being joined (e.g., see FIG. 30) and can even be laterally spaced from each other (e.g., see the middle right of FIG. 31 and FIG. 32) and still be an effective, force absorbing pad. In specific applications in which it may be more important to ensure or enhance high breathability in the pad, the beads 9 can be well spaced from each other as in pad 1'(*b*) of FIG. 33. This pad 1'(*b*) of FIG. 33 is essentially the same as pad 1 in FIG. 2 but with every other bead 9 omitted. In this embodiment of FIG. 33, the beads 9 act more as a spacer between the porous, breathable, fabric layers 3 and 5 to keep them from bottoming out against each other under an applied load such as 70 in FIG. 34. In this manner, the layers 3 and 5 of FIGS. 33 and 34 remain spaced apart to allow air and moistures to readily pass through the pad 1'(*b*). Were the layers 3 and 5 to touch or bottom out against each other, the ability of air and moisture to pass through the pad would be greatly inhibited. By keeping the layers 3 and 5 spaced from each other, air and moisture can then easily pass through the pad including the layers 3 and 5.

The total volume of the interstitial air space between the beads 9 in the pad 1'(*b*) of FIG. 33 is preferably at least as great as the total volume of the relaxed or uncompressed beads 9 and can be many times more. The beads 9 in this regard could be spaced one or more bead diameters or widths apart. In any event, pads such as 1'(*b*) with the widely spaced beads 9 (and to a lesser degree all of the pads of the present invention regardless of the bead spacing) can then easily pass air and moisture not only vertically (in the orientation of FIG. 33) but also horizontally or laterally through the pad.

Figure 34:
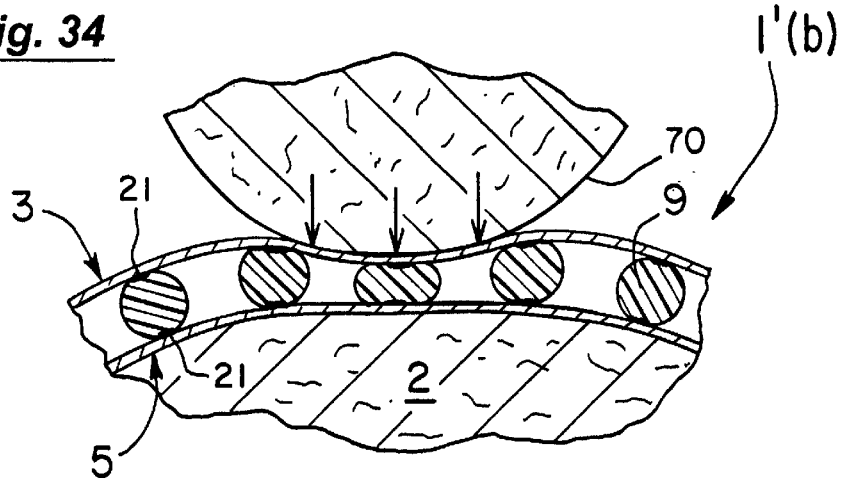
FIG. 34 shows the pad of FIG. 33 under a load.
Figure 35:
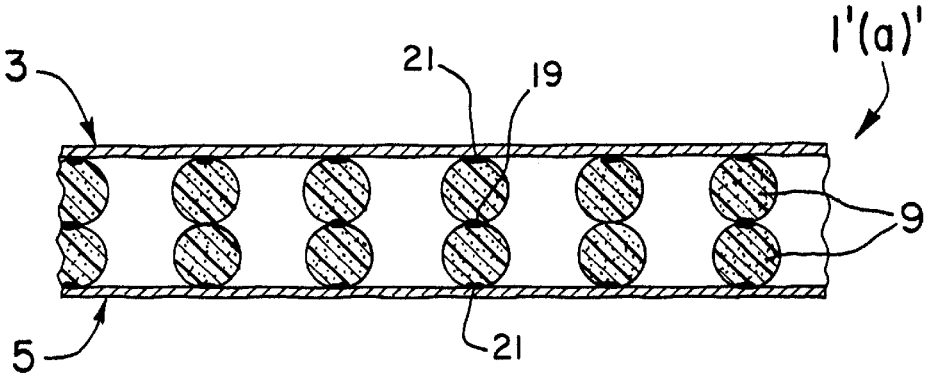
FIG. 35 illustrates a pad with multiple sublayers of beads with the beads in each sublayer well spaced from each other laterally.

Pads with the beads 9 well spaced from each other can also be made with multiple sublayers of beads 9 as in the pad 1(*a*)' of FIG. 35. The beads 9 in FIG. 35 as in the embodiments of FIGS. 33 and 34 are preferably joined at 21 to the outer, fabric layers 3 and 5. Additionally, the stacked sublayers of beads 9 can be joined to each other at 19 in FIG. 35 if desired or can remain unjoined as also illustrated in FIG. 35. The other layers 3 and 5 are preferably inelastic but could be elastic if desired in the fashion of outer layers 3' and 5' of FIG. 32. If the outer layers are elastic, the bead spacing would appear essentially as in FIG. 35 when the elastic, outer layers were relaxed and not stretched. These pads of FIGS. 33–35 could also have virtually all of the salient features and details of the pads of FIGS. 1–32.

While several embodiments of the present invention have been shown and described in detail, it is to be understood that various changes and modifications could be made without departing from the scope of the invention. As for example, the pads of the present invention have been primarily disclosed as adapted for use by athletes but they are equally adaptable for use wherever foam and other padding are used. The pad technology of the present invention in this regard could be used as pads for fences, poles, trees, and walls as well as in industrial applications such as elevators and vehicle bumpers. Similarly, the pads of the present invention could be used in industrial environments, particularly the pads for joints such as the knees and elbows. Padded helmets and head gear are additionally suitable. The basic pad structures as adapted for making entire pieces of clothing such as jerseys and pants are equally suitable for industrial clothing and other applications to protect the user. They are also adaptable for use in such items as seating, upholstery fabrics, and shoe liners. The pads of the present invention in this regard can be shaped and assembled using most fabric techniques (e.g., sold by the yard to be cut and sewn as desired even quilted as by stitching 26 and 26' for additional strength and ruggedness). Yet, the resulting product is padded and in most applications lies relatively flat against the user's body or other object to absorb forces and to distribute and dissipate them over a relative large area.

We claim:

1. A flexible pad primarily intended for use as protective padding for an athlete, said pad including:

first and second layers of flexible, porous, breathable, substantially inelastic material spaced apart by a plurality of discrete beads of substantially elastic, resilient material positioned between said first and second layers, said beads being adjacent one another and forming a middle section between said first and second layers with substantially all of said adjacent beads respectively abutting one another and being integrally joined to each other and having interstitial spaces therebetween wherein the middle section formed by said beads is porous and breathable, each of said first and second layers respectively contacting adjacent beads of said middle section and being integrally joined to substantially each bead contacted thereby at a first distinct location along the surface of the contacted bead and wherein substantially each of said contacted beads is further integrally joined at least at three more distinct locations along the surface thereof to adjacent beads or to a combination of adjacent beads and the other of the first and second layers wherein said first and second layers with said middle section of beads therebetween form said flexible pad.

2. The pad of claim 1 wherein the adjacent beads of said middle section form at least a first sublayer of substantially side-by-side beads with substantially all of said side-by-side beads of said first sublayer respectively abutting one another and being integrally joined to each other.

3. The pad of claim 2 wherein the adjacent beads of said middle section form at least a second sublayer of substantially side-by-side beads with substantially all of said side-by-side beads of said second sublayer respectively abutting one another and being integrally joined to each other.

4. The pad of claim 3 wherein beads in the respective first and second sublayers abut one another and are integrally joined to each other to integrally join said sublayers to each other.

5. The pad of claim 3 wherein the beads of the first sublayer are substantially the same size and the beads of the second sublayer are substantially the same size with the size of the beads of the second sublayer being larger than the size of the beads in the first sublayer.

6. The pad of claim 3 wherein substantially all of the beads of the second sublayer are softer and compress more easily than the beads of the first sublayer.

7. The pad of claim 3 wherein the adjacent beads of said middle section form at least a third sublayer of substantially side-by-side beads with substantially all of said side-by-side beads of said third sublayer respectively abutting one another and being integrally joined to each other.

8. The pad of claim 7 wherein beads in the respective second and third sublayers abut one another and are integrally joined to each other to integrally join said sublayers to each other.

9. The pad of claim 1 wherein said beads are of different sizes.

10. The pad of claim 1 wherein said beads are of different shapes.

11. The pad of claim 1 wherein said beads are of different softness.

12. The pad of claim 1 wherein the material of said beads is closed-cell foam.

13. The pad of claim 1 wherein the material of said beads is substantially waterproof.

14. The pad of claim 1 wherein the material of said first and second layers is substantially waterproof.

15. The pad of claim 1 wherein said adjacent, abutting beads are integrally joined to each other by an adhesive.

16. The pad of claim 1 wherein said first and second layers are integrally joined by an adhesive to the adjacent beads contacted thereby.

17. The pad of claim 1 further including a hard, outer shell.

18. The pad of claim 17 wherein said hard, outer shell is porous.

19. The pad of claim 17 wherein said pad is attached to said hard, outer shell.

20. The pad of claim 1 further including pressure sensitive adhesive on at least one of said first and second layers.

21. The pad of claim 20 wherein said at least one of said first and second layers has an outer surface facing away from said middle section of beads and said pressure sensitive adhesive is on said outer surface.

22. The pad of claim 1 wherein at least some of said beads have substantially flat areas abutting and integrally joined to each other.

23. The pad of claim 1 wherein at least some of said beads have substantially flat areas contacting and integrally joined to at least one of said first and second layers.

24. The pad of claim 1 wherein the pad is an article of clothing.

25. A flexible pad primarily intended for use as protective padding for an athlete, said pad including:

first and second layers of flexible, porous, breathable, substantially inelastic material spaced apart by a plurality of discrete beads of substantially elastic, resilient material positioned between said first and second layers, said beads being adjacent one another and forming a middle section between said first and second layers with substantially all of said adjacent beads respectively abutting one another and having interstitial spaces therebetween wherein the middle section formed by said beads is porous and breathable, each of said first and second layers respectively contacting adjacent beads of said middle section and being integrally joined to substantially each bead contacted thereby at a first distinct location along the surface of the contacted bead and wherein substantially each of said contacted beads is further integrally joined at least at three more distinct locations along the surface thereof to adjacent beads or to a combination of adjacent beads and the other of the first and second layers wherein said first and second layers with said middle section of beads therebetween form said flexible pad.

26. The pad of claim 25 wherein the adjacent beads of said middle section form at least a first sublayer of substantially side-by-side beads with substantially all of said side-by-side beads of said first sublayer respectively abutting one another.

27. The pad of claim 26 wherein the adjacent beads of said middle section form at least a second sublayer of substantially side-by-side beads with substantially all of said side-by-side beads of said second sublayer respectively abutting one another.

28. The pad of claim 27 wherein beads in the respective first and second sublayers abut one another and are integrally joined to each other to integrally join said sublayers to each other.

29. The pad of claim 25 wherein the material of said beads is closed-cell foam.

30. The pad of claim 25 wherein the material of said beads is substantially waterproof.

31. The pad of claim 25 wherein the material of said first and second layers is substantially waterproof.

32. The pad of claim 25 wherein said first and second layers are integrally joined by an adhesive to the adjacent beads contacted thereby.

33. The pad of claim 25 wherein the pad is an article of clothing.

34. A flexible pad primarily intended for use as protective padding for an athlete, said pad including:

first and second layers of flexible, porous, breathable material spaced apart by a plurality of discrete beads of substantially elastic, resilient material positioned between said first and second layers, said beads being adjacent one another and forming a middle section between said first and second layers, said beads having interstitial spaces therebetween wherein the middle section formed by said beads is porous and breathable, each of said first and second layers respectively contacting adjacent beads of said middle section and being integrally joined to substantially each bead contacted thereby at a first distinct location along the surface of the contacted bead and wherein substantially each of said contacted beads is further integrally joined at least at three more distinct locations along the surface thereof to adjacent beads or to a combination of adjacent beads and the other of the first and second layers wherein at least one of said first and second layers is made of substantially elastic, resilient material.

35. The pad of claim 34 wherein the adjacent beads of said middle section form at least a first sublayer of substantially side-by-side beads.

36. The pad of claim 35 wherein the adjacent beads of said middle section form at least a second sublayer of substantially side-by-side beads.

37. The pad of claim 36 wherein the beads in the respective first and second sublayers abut one another and are integrally joined to each other.

38. The pad of claim 34 wherein both of said first and second layers are made of substantially elastic, resilient material.

39. The pad of claim 34 wherein the material of said beads is closed-cell foam.

40. The pad of claim 34 wherein the material of said beads is substantially waterproof.

41. The pad of claim 34 wherein the material of said first and second layers is substantially waterproof.

42. The pad of claim 34 wherein said first and second layers are integrally joined by an adhesive to the adjacent beads contacted thereby.

43. The pad of claim 34 wherein the pad is an article of clothing.

* * * * *